US010782637B1

(12) United States Patent
Fujimoto et al.

(10) Patent No.: US 10,782,637 B1
(45) Date of Patent: Sep. 22, 2020

(54) FIXING DEVICE AND IMAGE FORMING APPARATUS INCORPORATING SAME

(71) Applicants: Ippei Fujimoto, Kanagawa (JP); Yoshiki Yamaguchi, Kanagawa (JP)

(72) Inventors: Ippei Fujimoto, Kanagawa (JP); Yoshiki Yamaguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/802,714

(22) Filed: Feb. 27, 2020

(30) Foreign Application Priority Data

Mar. 14, 2019 (JP) ..... 2019-047036

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/206; G03G 15/2064
See application file for complete search history.

(56) References Cited

U.S. PATENT DOCUMENTS 10,488,798 B2 * 11/2019 Yoshinaga ..... G03G 15/2064
10,564,577 B2 * 2/2020 Yabuki ..... G03G 15/2028
2017/0102652 A1 4/2017 Imada et al.
2018/0157198 A1 6/2018 Seto et al.
2018/0284663 A1 10/2018 Matsuda et al.
2018/0356754 A1 12/2018 Yoshinaga et al.
2019/0286025 A1 9/2019 Yamaguchi et al.

FOREIGN PATENT DOCUMENTS

JP 2015-055709 3/2015
JP 2015-055710 3/2015
JP 2018-205660 12/2018

* cited by examiner

*Primary Examiner* — Hoang X Ngo
(74) *Attorney, Agent, or Firm* — Oblon, McClelland, Maier & Neustadt, L.L.P.

(57) ABSTRACT

A fixing device includes a fixing rotator, a pressure rotator, a heat source, a nip formation pad, and a support. The nip formation pad presses against the pressure rotator to form a fixing nip between the fixing rotator and the pressure rotator. The support supports the nip formation pad toward the fixing nip. A longitudinal end portion of the pressure rotator has an outer diameter greater than that of a longitudinal center portion of the pressure rotator. The pressure rotator includes a grip that contacts the nip formation pad via the fixing rotator outside a recording medium with a maximum width conveyable passing through the fixing nip and applies a frictional force to the fixing rotator. The nip formation pad includes a nip face having an inflection point from which a longitudinal direction of the nip face is curved toward the support within an area opposite the grip.

6 Claims, 5 Drawing Sheets

FIXING DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2019-047036, filed on Mar. 14, 2019, in the Japan Patent Office, the entire disclosure of which is hereby incorporated by reference herein.

BACKGROUND

Technical Field

Embodiments of the present disclosure generally relate to a fixing device and an image forming apparatus incorporating the fixing device, and more particularly, to a fixing device for fixing a toner image onto a recording medium and an image forming apparatus for forming an image on a recording medium with the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, an image is formed on the recording medium.

Such a fixing device often employs a fixing film system that shortens a heating startup time. In the fixing film system, a pressure roller contacts a nip formation pad via a thin fixing film to form a fixing nip between the pressure roller and the fixing film. An inner circumferential surface of the fixing film slides over a surface of the nip formation pad via a lubricant.

SUMMARY

In one embodiment of the present disclosure, a novel fixing device includes a fixing rotator, a pressure rotator, a heat source, a nip formation pad, and a support. The pressure rotator is disposed opposite the fixing rotator. The heat source is configured to heat the fixing rotator. The nip formation pad is configured to press against the pressure rotator via the fixing rotator to form a fixing nip between the fixing rotator and the pressure rotator. The support is configured to support the nip formation pad toward the fixing nip. A longitudinal end portion of the pressure rotator has an outer diameter greater than an outer diameter of a longitudinal center portion of the pressure rotator. The pressure rotator includes a grip that is configured to contact the nip formation pad via the fixing rotator outside a recording medium passing through the fixing nip and apply a frictional force to the fixing rotator. The recording medium has a maximum width conveyable in the fixing device. The nip formation pad includes a nip face having an inflection point from which a longitudinal direction of the nip face is curved toward the support within an area opposite the grip.

Also described is a novel image forming apparatus incorporating the fixing device.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
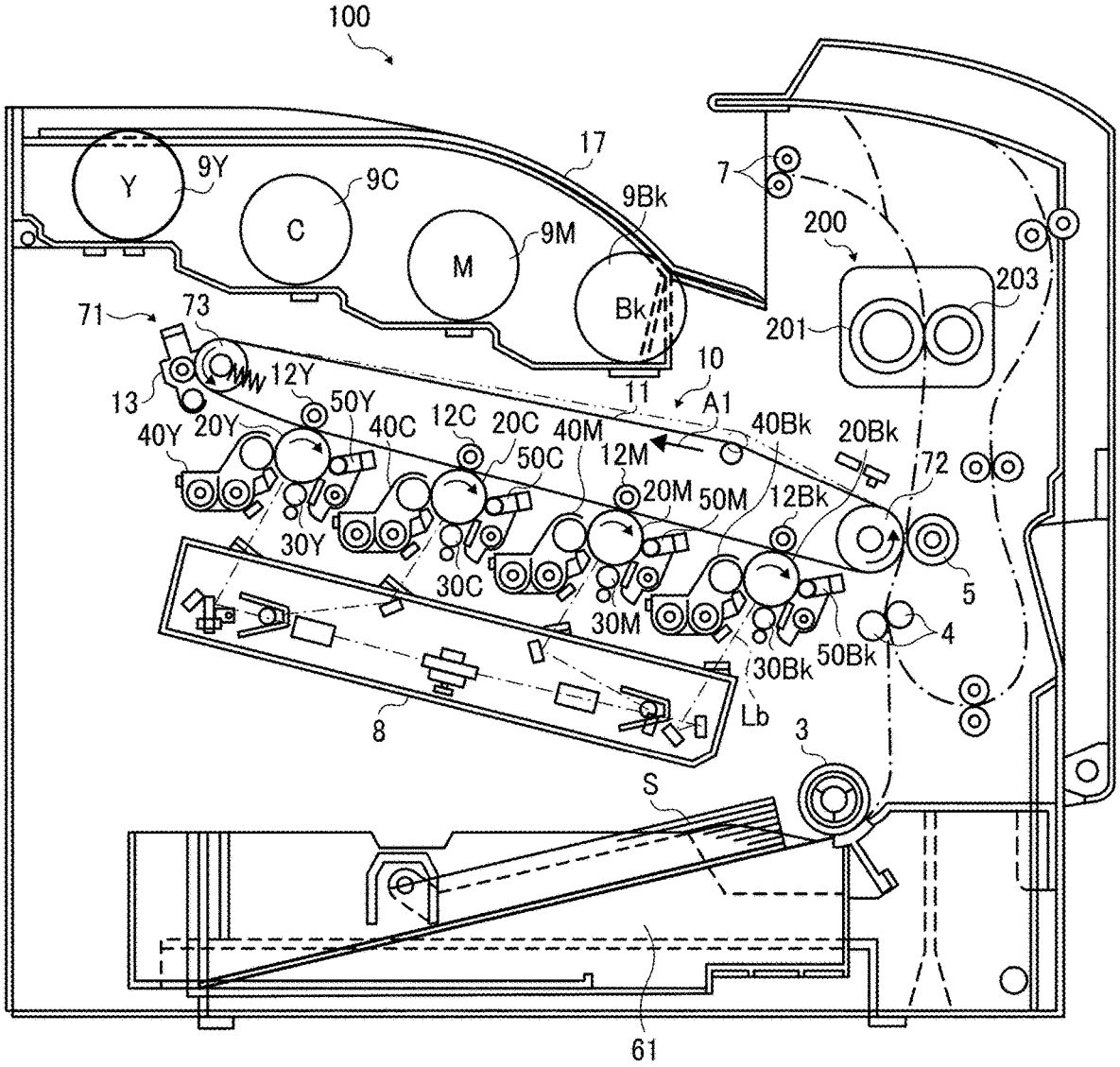
FIG. 1 is a schematic view of an image forming apparatus according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

As used herein, the singular forms "a," "an," and "the" are intended to include the plural forms as well, unless the context clearly indicates otherwise.

It is to be noted that, in the following description, suffixes Y, C, M, and Bk denote colors of yellow, cyan, magenta, and black, respectively. To simplify the description, these suffixes are omitted unless necessary.

Referring to the drawings, wherein like reference numerals designate identical or corresponding parts throughout the several views, embodiments of the present disclosure are described below.

According to an embodiment of the present disclosure, a fixing device includes a fixing rotator, a pressure rotator, a heat source, a nip formation pad, and a support. The pressure rotator is disposed opposite the fixing rotator. The heat source is configured to heat the fixing rotator. The nip formation pad is configured to press against the pressure rotator via the fixing rotator to form a fixing nip between the fixing rotator and the pressure rotator. The support is configured to support the nip formation pad toward the fixing nip. A longitudinal end portion of the pressure rotator has an outer diameter greater than an outer diameter of a longitudinal center portion of the pressure rotator. The pressure rotator includes a grip that is configured to contact the nip formation pad via the fixing rotator outside a recording medium passing through the fixing nip and apply a frictional force to the fixing rotator. The recording medium has a maximum width conveyable in the fixing device. The nip formation pad includes a nip face having an inflection point from which a longitudinal direction of the nip face is curved toward the support within an area opposite the grip.

Initially with reference to FIG. 1, a description is given of an image forming apparatus 100 according to an embodiment of the present disclosure.

FIG. 1 is a schematic view of the image forming apparatus 100.

As illustrated in FIG. 1, the image forming apparatus 100 is a color printer employing a tandem system in which a plurality of image forming devices for forming toner images in a plurality of colors, respectively, is aligned in a direction in which a transfer belt is stretched and rotates.

Alternatively, the image forming apparatus 100 may employ other structures. The image forming apparatus 100 illustrated in FIG. 1 forms color and monochrome images on recording media by electrophotography. Alternatively, the image forming apparatus 100 may be a monochrome printer that forms monochrome images on recording media. Although FIG. 1 illustrates the image forming apparatus 100 as a color printer, the image forming apparatus 100 may be, e.g., a copier, a facsimile machine, or a multifunction peripheral (MFP) having at least two of printing, copying, scanning, facsimile, and plotter functions.

As illustrated in FIG. 1, the image forming apparatus 100 employs a tandem structure in which four drum-shaped photoconductors 20Y, 20C, 20M, and 20Bk are arranged side by side as image bearers that bear yellow, cyan, magenta, and black toner images in separation colors, respectively.

The image forming apparatus 100 includes a transfer belt 11, which is an endless belt serving as an intermediate transferor rotatable in a direction of rotation A1 while facing the photoconductors 20Y, 20C, 20M, and 20Bk. In a primary transfer process, the yellow, cyan, magenta, and black toner images formed as visible images on the photoconductors 20Y, 20C, 20M, and 20Bk, respectively, are transferred successively onto the transfer belt 11 as the transfer belt 11 rotates in the direction of rotation A1 in FIG. 1. Specifically, in the primary transfer process, the yellow, cyan, magenta, and black toner images are superimposed one atop another on the transfer belt 11, thus being transferred onto the transfer belt 11. Thereafter, in a secondary transfer process, the yellow, cyan, magenta, and black toner images are transferred at once onto a recording medium S, such as a recording sheet, from the transfer belt 11.

Each of the photoconductors 20Y, 20C, 20M, and 20Bk is surrounded by various pieces of equipment to form a toner image in accordance with rotation of each of the photoconductors 20Y, 20C, 20M, and 20Bk. Specifically, for example, the photoconductor 20Bk is surrounded by a charger 30Bk, a developing device 40Bk, a primary transfer roller 12Bk, and a cleaner 50Bk in this order along a direction of rotation of the photoconductor 20Bk. A black toner image is formed on the photoconductor 20Bk while the photoconductor 20Bk rotates. Like the photoconductor 20Bk, the photoconductors 20Y, 20C, and 20M are surrounded by chargers 30Y, 30C, and 30M, developing devices 40Y, 40C, and 40M, primary transfer rollers 12Y, 12C, and 12M, and cleaners 50Y, 50C, and 50M in this order along a direction of rotation of the photoconductors 20Y, 20C, and 20M, respectively. After the chargers 30Y, 30C, 30M, and 30Bk charge the respective photoconductors 20Y, 20C, 20M, and 20Bk, an optical writing device 8 writes electrostatic latent images on the photoconductors 20Y, 20C, 20M, and 20Bk with laser beams Lb serving as writing light, respectively.

As the transfer belt 11 rotates in the direction of rotation A1, the yellow, cyan, magenta, and black toner images formed as visible images on the photoconductors 20Y, 20C, 20M, and 20Bk, respectively, are primarily transferred onto the transfer belt 11 such that the yellow, cyan, magenta, and black toner images are superimposed one atop another on the transfer belt 11. In the primary transfer process, the primary transfer rollers 12Y, 12C, 12M, and 12Bk disposed opposite the photoconductors 20Y, 20C, 20M, and 20Bk via the transfer belt 11, respectively, apply a primary transfer bias to the photoconductors 20Y, 20C, 20M, and 20Bk to transfer the yellow, cyan, magenta, and black toner images onto the transfer belt 11 in this order from an upstream side to a downstream side in the direction of rotation A1 of the transfer belt 11.

That is, the photoconductors 20Y, 20C, 20M, and 20Bk are aligned in this order from the upstream side in the direction of rotation A1 of the transfer belt 11. The photoconductors 20Y, 20C, 20M, and 20Bk are located in four image forming stations that form the yellow, cyan, magenta, and black toner images, respectively. Hereinafter, the four image forming stations may be occasionally referred to as yellow, cyan, magenta, and black image forming stations.

In other words, the image forming apparatus 100 includes the yellow, cyan, magenta, and black image forming stations. In addition, the image forming apparatus 100 includes a transfer belt unit 10, a secondary transfer roller 5, a transfer belt cleaner 13, and the optical writing device 8. The transfer belt unit 10 is disposed above and opposite the photoconductors 20Y, 20C, 20M, and 20Bk. The transfer belt unit 10 includes the transfer belt 11 and the primary transfer rollers 12Y, 12C, 12M, and 12Bk. The secondary transfer roller 5 is disposed opposite the transfer belt 11 and rotated in accordance with rotation of the transfer belt 11. The transfer belt cleaner 13 is disposed opposite the transfer belt 11 to clean the transfer belt 11. The optical writing device 8 is disposed below and opposite the four image forming stations.

The optical writing device 8 includes, e.g., a semiconductor laser serving as a light source, a coupling lens, an fθ lens, a toroidal lens, a deflection mirror, and a rotatable polygon mirror serving as a deflector. According to image data of yellow, cyan, magenta, and black, the optical writing device 8 emits the laser beams Lb to the photoconductors 20Y, 20C, 20M, and 20Bk to form electrostatic latent images on the photoconductors 20Y, 20C, 20M, and 20Bk, respectively. FIG. 1 illustrates the laser beam Lb irradiating the photoconductor 20Bk in the black image forming station. Similarly, the laser beams Lb irradiate the other photoconductors 20Y, 20C, and 20M in the yellow, cyan, and magenta image forming stations, respectively.

The image forming apparatus 100 further includes a sheet feeding device 61 and a registration roller pair 4. The sheet feeding device 61 includes a sheet tray that loads a plurality of recording media S, which is conveyed one by one to an area of contact, herein referred to as a secondary transfer nip, formed between the transfer belt 11 and the secondary transfer roller 5. Activation of the registration roller pair 4 is timed to feed a recording medium S conveyed from the sheet feeding device 61 to the secondary transfer nip formed between the transfer belt 11 and the secondary transfer roller 5 such that the recording medium S meets the yellow, cyan, magenta, and black toner images on the transfer belt 11 at the secondary transfer nip. The image forming apparatus 100 further includes a sensor to detect that a leading end of the recording medium S reaches the registration roller pair 4.

In addition, the image forming apparatus 100 includes a fixing device 200, an output roller pair 7, an output tray 17, and toner bottles 9Y, 9C, 9M, and 9Bk. The fixing device 200 serves as a fixing or fusing unit herein employing a belt fixing system. When receiving a recording medium S bearing a toner image, the fixing device 200 fixes the toner image onto the recording medium S. The output roller pair 7 ejects the recording medium S bearing the fixed toner image outside a housing of the image forming apparatus 100. The output tray 17 is situated atop the housing of the image forming apparatus 100. The recording medium S is ejected onto the output tray 17 outside the housing of the image forming apparatus 100 by the output roller pair 7. The toner bottles 9Y, 9C, 9M, and 9Bk are situated below the output tray 17. The toner bottles 9Y, 9C, 9M, and 9Bk are replenished with fresh toner of yellow, cyan, magenta, and black, respectively.

In addition to the transfer belt 11 and the primary transfer rollers 12Y, 12C, 12M, and 12Bk, the transfer belt unit 10 includes a driving roller 72 and a driven roller 73. The transfer belt 11 is entrained around the driving roller 72 and the driven roller 73.

A biasing member, such as a spring, biases the driven roller 73 against the transfer belt 11. With such a configuration, the driven roller 73 serves as a tension applicator that applies tension to the transfer belt 11. The transfer belt unit 10, the secondary transfer roller 5, and the transfer belt cleaner 13 together construct a transfer device 71.

The sheet feeding device 61 is disposed in a lower portion of the housing of the image forming apparatus 100. The sheet feeding device 61 includes a sheet feeding roller 3 that contacts an upper surface of an uppermost recording medium S of the plurality of recording media S loaded on the sheet tray of the sheet feeding device 61. As the sheet feeding roller 3 is rotated counterclockwise in FIG. 1, the sheet feeding roller 3 feeds the uppermost recording medium S toward the registration roller pair 4.

The transfer belt cleaner 13 of the transfer device 71 includes a cleaning brush and a cleaning blade disposed so as to face and contact the transfer belt 11. With the cleaning brush and the cleaning blade, the transfer belt cleaner 13 scrapes extraneous matter such as residual toner off the transfer belt 11, thereby removing the extraneous matter from the transfer belt 11. Thus, the transfer belt cleaner 13 cleans the transfer belt 11.

The transfer belt cleaner 13 further includes a waste toner conveyer that conveys and discards the residual toner removed from the transfer belt 11.

Figure 2:
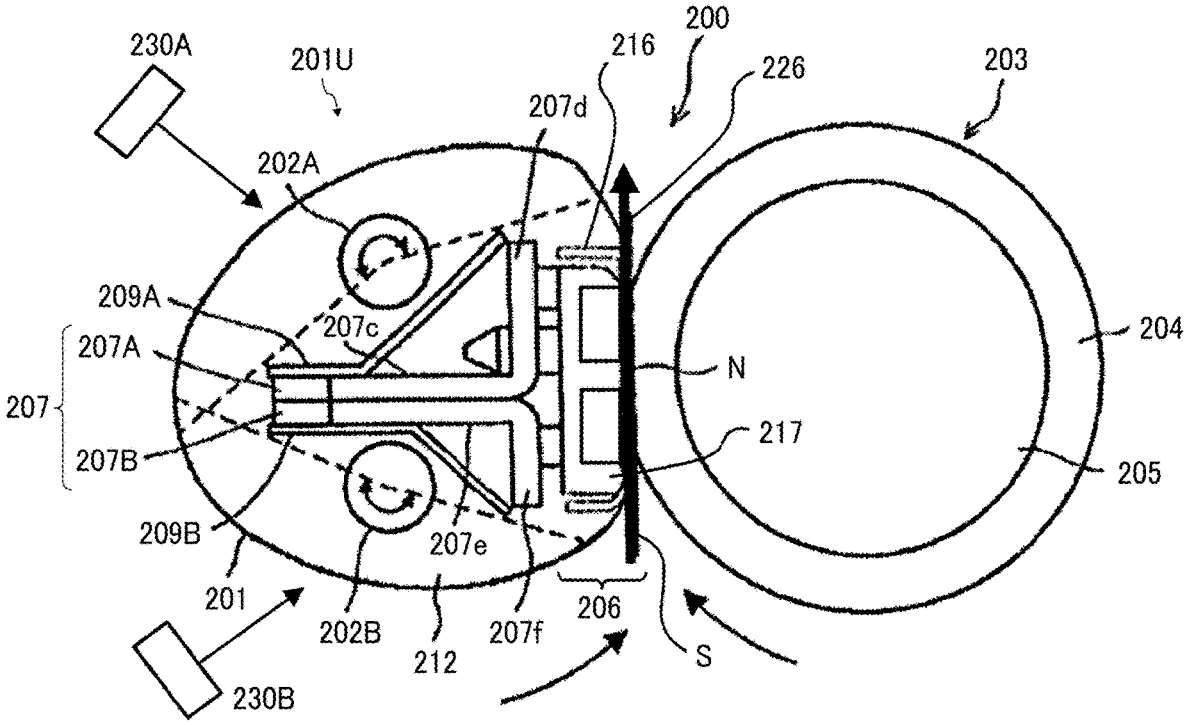
FIG. 2 is a schematic view of a fixing device incorporated in the image forming apparatus illustrated in FIG. 1.

Referring to FIG. 2, a description is given of a configuration of the fixing device 200 incorporated in the image forming apparatus 100 described above.

FIG. 2 is a schematic view of the fixing device 200.

As illustrated in FIG. 2, the fixing device 200 includes a fixing belt 201 as an endless belt formed into a loop, a pressure roller 203, and various components disposed inside the loop formed by the fixing belt 201, such as halogen heaters 202A and 202B, a nip formation pad 206, a stay 207, and reflectors 209A and 209B. The fixing belt 201 and the components disposed inside the loop formed by the fixing belt 201 constitute a belt unit 201U, which is detachably coupled to the pressure roller 203. The fixing belt 201 serves as a fixing rotator; whereas the pressure roller 203 serves as a pressure rotator disposed opposite an outer circumferential surface of the fixing belt 201. The halogen heaters 202A and 202B serve as a plurality of heat sources to heat the fixing belt 201 (i.e., fixing rotator). Specifically, the fixing belt 201 is directly heated with radiation heat from the halogen heaters 202A and 202B, from an inside of the loop formed by the fixing belt 201. The fixing device 200 further includes temperature sensors 230A and 230B to detect the temperature of the fixing belt 201. The temperature sensors 230A and 230B are herein non-contact sensors that detect the temperature of fixing belt 201 without contacting the fixing belt 201. The fixing device 200 controls the lighting rate of the halogen heaters 202A and 202B according to the temperature detected, thus controlling the temperature of the fixing belt 201 to a desired temperature.

As illustrated in FIG. 2, the nip formation pad 206 presses against the pressure roller 203 (i.e., pressure rotator) via the fixing belt 201 (i.e., fixing rotator) to form an area of contact, herein referred to as a fixing nip N, between the fixing belt 201 (i.e., fixing rotator) and the pressure roller 203 (i.e., pressure rotator). As the fixing belt 201 rotates, the fixing belt 201 slides over the nip formation pad 206. Specifically, an inner circumferential surface of the fixing belt 201 slides over a thermal conduction aid 216 of the nip formation pad 206. A toner image is fixed onto a recording medium S under heat and pressure at the fixing nip N while the recording medium S bearing the toner image is sandwiched between the fixing belt 201 and the pressure roller 203 and conveyed through the fixing nip N. Although FIG. 2 illustrates the thermal conduction aid 216 in a flat shape, the thermal conduction aid 216 may be contoured into a recess or other shapes. In a case in which the thermal conduction aid 216 contours the fixing nip N into a recess, the recessed fixing nip N directs a leading end of the recording medium S toward the pressure roller 203 as the recording medium S is ejected from the fixing nip N. Thus, the recessed fixing nip N facilitates separation of the recording medium S from the fixing belt 201 and prevents a paper jam.

The thermal conduction aid 216 illustrated in FIG. 2 has a belt-side surface (or simply referred to as a belt side) that contacts the inner circumferential surface of the fixing belt 201 (i.e., fixing rotator). The belt-side surface of the thermal conduction aid 216 is coated to reduce a frictional force generated between the thermal conduction aid 216 and the fixing belt 201, thus restraining abrasion of the thermal conduction aid 216 and the fixing belt 201. The belt-side surface of the thermal conduction aid 216 is coated with fluorine having low friction or a material having an increased abrasion resistance such as a diamond-like carbon (DLC). The thermal conduction aid 216 is a metal material having the belt-side surface coated. Therefore, the thermal conduction aid 216 is not deformed in a thickness direction of the thermal conduction aid 216 and affected when a nip surface pressure is increased between the thermal conduction aid 216 and a grip 301 of the pressure roller 203. To address such a situation, it is effective to reduce a surface pressure of the grip 301 of the pressure roller 203.

The nip formation pad 206 is disposed inside the loop formed by the fixing belt 201 and opposite the pressure roller 203 via the fixing belt 201. The nip formation pad 206 includes the thermal conduction aid 216 and a base 217. The thermal conduction aid 216 is a slide aid that covers a belt-side surface of the base 217. The belt-side surface of the base 217 is a surface opposite the inner circumferential surface of the fixing belt 201. The base 217 is a slide aid support that supports the thermal conduction aid 216 (i.e., slide aid). The stay 207 holds the nip formation pad 206 against pressure from the pressure roller 203.

The thermal conduction aid 216 prevents heat generated by a longitudinal end heater 226 from being stored locally and facilitates conduction of heat in a longitudinal direction of the thermal conduction aid 216. Thus, the thermal conduction aid 216 reduces uneven temperature of the fixing belt 201 in an axial direction of the fixing belt 201. Hence, the thermal conduction aid 216 is preferably made of a material that conducts heat quickly, for example, a material having an increased thermal conductivity such as copper, aluminum, or silver. In a comprehensive view of manufacturing costs, availability, thermal conductivity, and processing, copper is a most preferable material used as the thermal conduction aid 216. As described above, in the present embodiment, the thermal conduction aid 216 includes the belt-side surface facing the inner circumferential surface of the fixing belt 201. The belt-side surface of the thermal conduction aid 216 directly contacts the fixing belt 201 and therefore serves as a nip formation surface.

The fixing belt 201 is an endless belt or film made of a metal material, such as nickel or stainless steel (e.g., steel use stainless or SUS), or a resin material such as polyimide. The fixing belt 201 is constructed of a base layer and a release layer. The release layer, as an outer surface layer of the fixing belt 201, is made of, e.g., perfluoroalkoxy alkane (PFA) or polytetrafluoroethylene (PTFE) to facilitate separation of toner contained in a toner image on a recording medium S from the fixing belt 201. Optionally, an elastic layer made of, e.g., silicone rubber may be interposed between the base layer and the release layer made of, e.g., PFA or PTFE of the fixing belt 201. In a case in which the fixing belt 201 does not incorporate the elastic layer made of, e.g., silicone rubber, the fixing belt 201 has a decreased thermal capacity that improves fixing property of being heated quickly to a desired fixing temperature at which the toner image is fixed onto the recording medium S. However, as the pressure roller 203 and the fixing belt 201 sandwich and press an unfixed toner image onto the recording medium S, slight surface asperities in the fixing belt 201 may be transferred onto the toner image on the recording medium S, resulting in variation in gloss of a solid portion of the toner image. In short, an orange peel image appears on the recording medium S. The elastic layer made of, e.g., silicone rubber having a thickness not smaller than 100 μm is preferably provided to address such an unfavorable situation. As the elastic layer made of, e.g., silicone rubber deforms, the elastic layer absorbs the slight surface asperities in the fixing belt 201, thereby preventing formation of the faulty orange peel image.

The stay 207 is constructed of a first part 207A and a second part 207B. The first part 207A includes an arm portion 207*c* and a base portion 207*d*. The second part 207B includes an arm portion 207*e* and a base portion 207*f*. The arm portions 207*c* and 207*e* project from the base portions 207*d* and 207*f*, respectively, away from the fixing nip N. The arm portions 207*c* and 207*e* are interposed between the halogen heaters 202A and 202B serving as fixing heat sources. The halogen heaters 202A and 202B emit light that irradiates the inner circumferential surface of the fixing belt 201, thus heating the fixing belt 201 directly with radiation heat.

Figure 3:
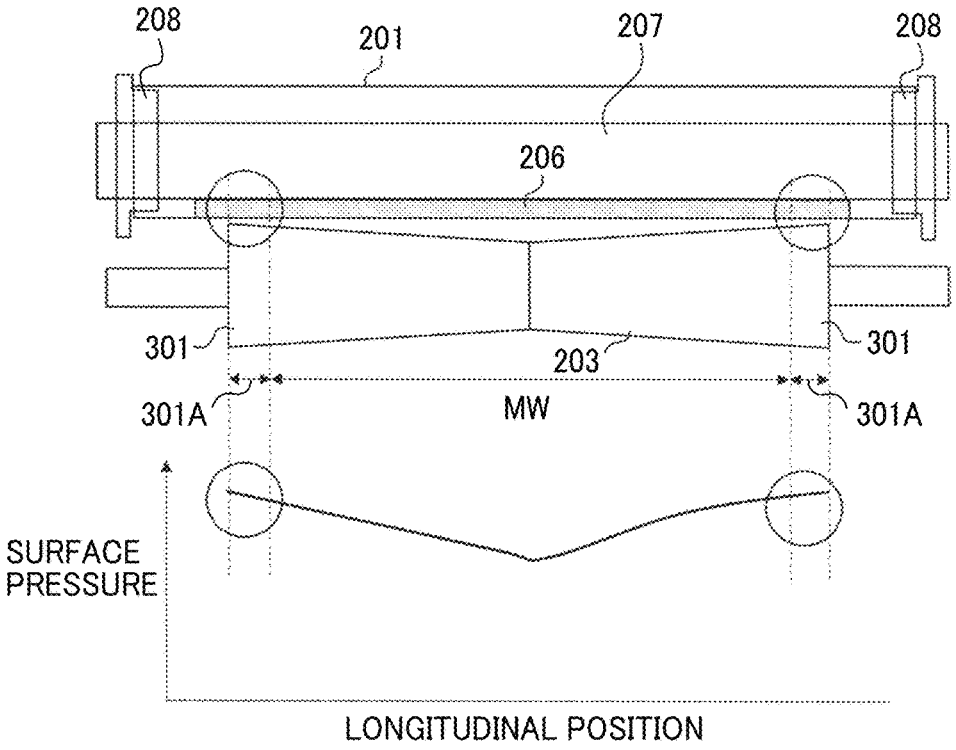
FIG. 3 is a diagram illustrating relative lengths of components of the fixing device illustrated in FIG. 2, with a graph of a surface pressure distribution in a fixing nip.
Figure 6:
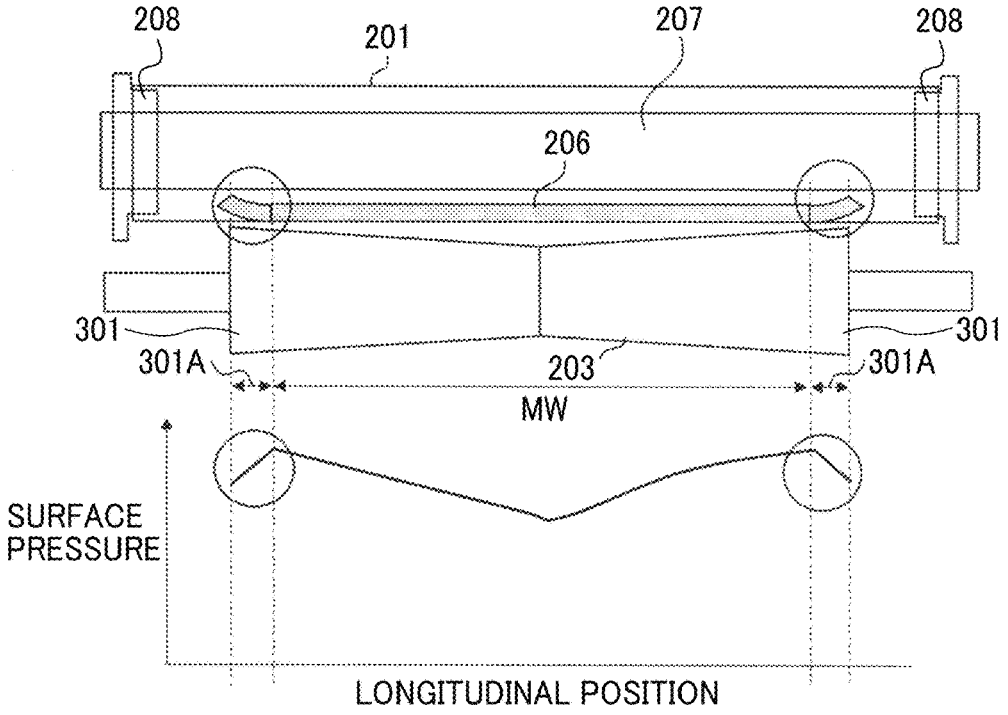
FIG. 6 is a diagram illustrating relative lengths of the components of the fixing device in a case in which the nip formation pad is shaped as illustrated in the enlarged view in FIG. 4, with a graph of a surface pressure distribution in the fixing nip.

The stay 207 is a support disposed inside the loop formed by the fixing belt 201. The stay 207 supports the nip formation pad 206 toward the fixing nip N as illustrated in FIG. 2. Thus, the stay 207 also supports the fixing nip N. As the nip formation pad 206 receives pressure from the pressure roller 203, the stay 207 prevents the nip formation pad 206 from being bent by such pressure, thereby maintaining a uniform width of the fixing nip N in the axial direction of the fixing belt 201. The stay 207 is held and secured by flanges 208 as illustrated in FIGS. 3 and 6. The flanges 208 serve as holders that holds opposed longitudinal end portions of the stay 207. Thus, the stay 207 is positioned inside the fixing device 200. Note that a longitudinal direction of the stay 207 is parallel to the axial direction of the fixing belt 201. The reflector 209A is interposed between the halogen heater 202A and the stay 207. Similarly, the reflector 209B is interposed between the halogen heater 202B and the stay 207. The reflectors 209A and 209B thus disposed reflect the radiation heat from the halogen heaters 202A and 202B toward the inner circumferential surface of the fixing belt 201. Accordingly, the reflectors 209A and 209B prevents the stay 207 from being heated with, e.g., the radiation heat from the halogen heaters 202A and 202B, thus reducing waste of energy. In a case in which the fixing device 200 excludes the reflectors 209A and 209B, the respective surfaces of the stay 207 facing the halogen heaters 202A and 202B may be insulated or given a mirror finish to reflect the radiation heat from the halogen heaters 202A and 202B toward the inner circumferential surface of the fixing belt 201. As illustrated in FIG. 2, the reflectors 209A and 209B interposed between the halogen heaters 202A and 202B prevent the halogen heaters 202A and 202B from heating glass tubes of each other. Accordingly, the halogen heaters 202A and 202B efficiently heat the fixing belt 201.

The pressure roller 203 is constructed of, e.g., a core 205, an elastic rubber layer 204 resting on the core 205, and a surface release layer resting on the elastic rubber layer 204. The release layer, made of PFA or PTFE, facilitates separation of the recording medium S from the pressure roller 203. A driver such as a motor situated inside the image forming apparatus 100 generates and transmits a driving force to the pressure roller 203 through a gear train, thus rotating the pressure roller 203. A spring, for example, presses the pressure roller 203 against the nip formation pad 206 via the fixing belt 201. As the spring presses and deforms the elastic rubber layer 204 of the pressure roller 203, the pressure roller 203 forms the fixing nip N having a given width, which is a given length in a recording medium conveying direction in which the recording medium S is conveyed. The pressure roller 203 may be a hollow roller or a solid roller. In a case in which the pressure roller 203 is a hollow roller, a heat source such as a halogen heater may be disposed inside the hollow roller. The elastic rubber layer 204 may be made of solid rubber. Alternatively, in a case in which no heater is situated inside the pressure roller 203, the elastic rubber layer 204 may be made of sponge rubber. The sponge rubber is preferable to the solid rubber because the sponge rubber has enhanced thermal insulation that draws less heat from the fixing belt 201.

The fixing belt 201 rotates in accordance with rotation of the pressure roller 203. In the example of FIG. 2, as a driver drives and rotates the pressure roller 203, a driving force of the driver is transmitted from the pressure roller 203 to the fixing belt 201 through the fixing nip N, thus rotating the fixing belt 201 by friction between the pressure roller 203 and the fixing belt 201. At the fixing nip N, the fixing belt 201 rotates while being sandwiched between the pressure roller 203 and the nip formation pad 206. At a circumferential span of the fixing belt 201 other than the fixing nip N, the fixing belt 201 rotates while opposed axial end portions of the fixing belt 201 are guided by the flanges 208.

With the configuration described above, the fixing device 200 attaining quick warm-up is manufactured at reduced costs.

Referring now to FIG. 3, a description is given of relative lengths of the components of the fixing device 200 described above.

FIG. 3 is a diagram illustrating the relative lengths of the components of the fixing device 200, with a graph of a surface pressure distribution in the fixing nip N.

As illustrated in FIG. 3, the nip formation pad 206 is longer than the pressure roller 203 to prevent longitudinal edges of the nip formation pad 206 from damaging the pressure roller 203. The pressure roller 203 is longer than a maximum recording medium conveyance width MW, which is a maximum width of a recording medium S conveyable in the image forming apparatus 100. The pressure roller 203 includes grips 301 at opposed longitudinal end portions of the pressure roller 203 outside the maximum recording medium conveyance width MW. In other words, the pressure roller 203 (i.e., pressure rotator) includes the grips 301 that contacts the nip formation pad 206 via the fixing belt 201 (i.e., fixing rotator) outside a recording medium S with a maximum width conveyable in the fixing device 200 passing through the fixing nip N and that applies a frictional force to the fixing belt 201 (i.e., fixing rotator). Accordingly, the grips 301 prevent slippage of the fixing belt 201 that rotates in accordance with rotation of the pressure roller 203.

As illustrated in FIG. 3, the pressure roller 203 has a so-called hourglass shape. That is, the pressure roller 203 has an outer diameter increasing from a longitudinal center portion of the pressure roller 203 toward the opposed longitudinal end portions of the pressure roller 203. With such a configuration, the opposed longitudinal end portions of the pressure roller 203 convey a recording medium S more quickly than the longitudinal center portion of the pressure roller 203, thereby preventing wrinkles of the recording medium S. Specifically, in the present example, the longitudinal center portion of the pressure roller 203 has an outer diameter of φ29.5 mm; whereas each of the opposed longitudinal end portions of the pressure roller 203 has an outer diameter of φ30.0 mm. In short, the longitudinal end portion of the pressure roller 203 (i.e., pressure rotator) has an outer diameter greater than an outer diameter of the longitudinal center portion of the pressure roller 203 (i.e., pressure rotator). That is, each of the opposed longitudinal end portions of the pressure roller 203 has an outer diameter greater than the longitudinal center portion of the pressure roller 203 by 0.5 mm. With such a configuration, the pressure roller 203 prevents wrinkles of the recording medium S.

FIG. 3 illustrates a case in which the nip formation pad 206 is flat and substantially parallel to an axis of the core 205 of the pressure roller 203. The lower portion of FIG. 3 illustrates the surface pressure distribution in the fixing nip N when the pressure roller 203 is pressed against the flat nip formation pad 206 to form the fixing nip N. Since the pressure roller 203 has an outer diameter increasing from the longitudinal center portion of the pressure roller 203 to the opposed longitudinal end portions of the pressure roller 203, a deformed amount of the elastic rubber layer 204 of the pressure roller 203 pressed against the nip formation pad 206 is greater at the opposed longitudinal end portions of the pressure roller 203 than at the longitudinal center portion of the pressure roller 203. That is, the opposed longitudinal end portions of the pressure roller 203 have a surface pressure greater than a surface pressure of the longitudinal center portion of the pressure roller 203. In other words, as illustrated in FIG. 3, the grips 301 exhibit a highest surface pressure in the longitudinal direction of the pressure roller 203. In such a situation, the inner circumferential surface of the fixing belt 201 and the belt-side surface of the nip formation pad 206 are likely to wear in a grip area 301A, which is an area opposite the grip 301. Abrasion of the inner circumferential surface of the fixing belt 201 or the belt-side surface of the nip formation pad 206 in the grip area 301A increases a sliding friction at the fixing nip N. Such an increase in sliding friction may cause slippage of the fixing belt 201, resulting in temperature abnormalities and a paper jam due to a conveyance failure of a recording medium S.

Figure 4:
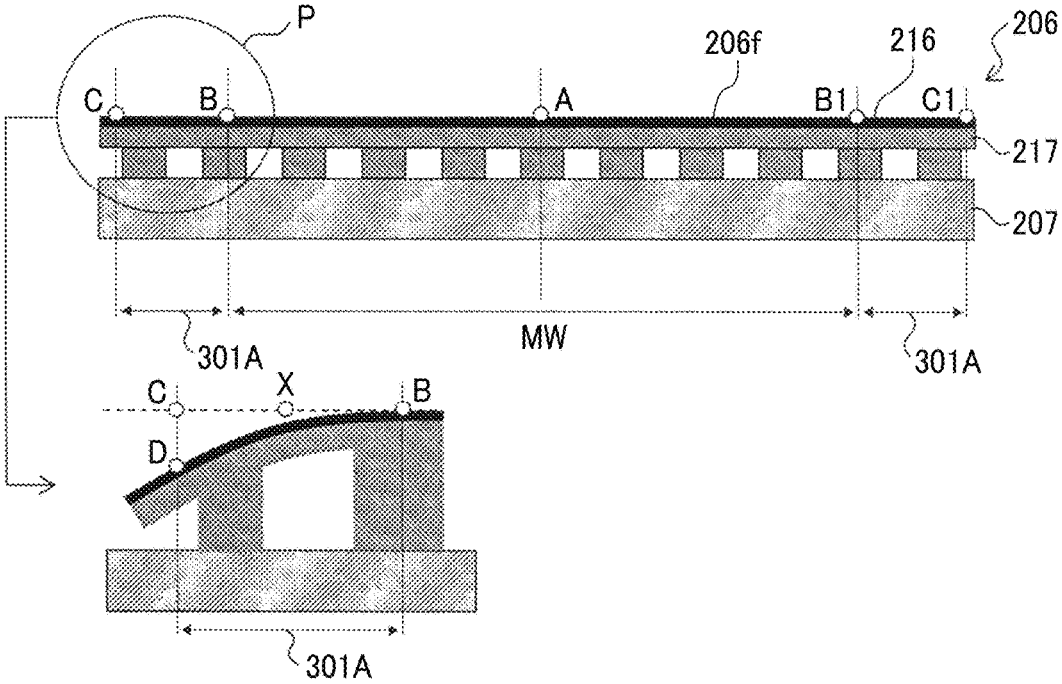
FIG. 4 is a diagram illustrating a nip formation pad, with an enlarged view of an example of a longitudinal end portion of the nip formation pad having a shape changed.
Figure 5:
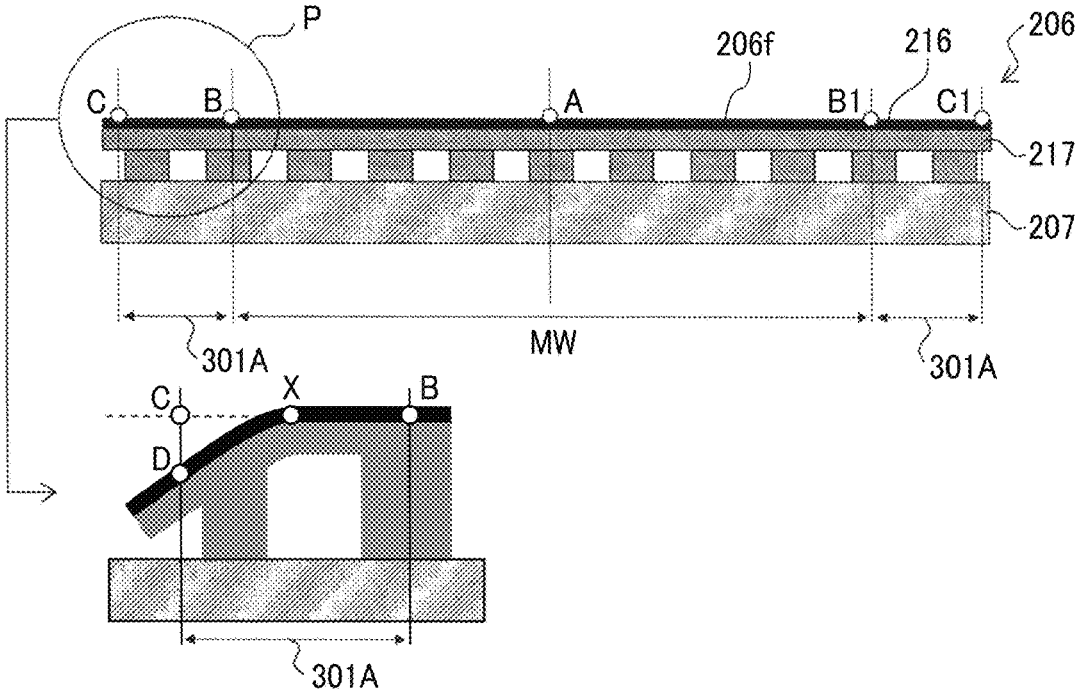
FIG. 5 is a diagram illustrating the nip formation pad, with an enlarged view of another example of the longitudinal end portion of the nip formation pad curved from a middle within a grip area.

Referring now to FIGS. 4 and 5, a description is given of the nip formation pad 206 having longitudinal end portions shaped to reduce the surface pressure of the grips 301.

FIG. 4 is a diagram illustrating the nip formation pad 206, with an enlarged view of an example of the longitudinal end portion of the nip formation pad 206 having a shape changed. FIG. 5 is a diagram illustrating the nip formation pad 206, with an enlarged view of another example of the longitudinal end portion of the nip formation pad 206 curved from a middle within the grip area 301A.

According to the present embodiment, the fixing device 200 includes the pressure roller 203 as a driving roller, the fixing belt 201 (or a fixing film) driven to rotate by the pressure roller 203, and the nip formation pad 206. The pressure roller 203 has an hourglass shape to prevent wrinkles of a recording medium S. The shape of the nip formation pad 206 prevents an increase in surface pressure near the opposed longitudinal end portions of the pressure roller 203 in an area of pressure between the pressure roller 203 and the nip formation pad 206. Accordingly, the present embodiment lengthens the lifespan of the fixing device 200 while keeping stable conveyance of recording media S.

As illustrated in FIG. 4, the longitudinal position of the thermal conduction aid 216 is determined as follows. Along a longitudinal direction of the thermal conduction aid 216, a point A corresponds to a center of the maximum recording medium conveyance width MW, which may be referred to as a maximum recording medium conveyance area. Points B and B1 correspond to opposed ends of the maximum recording medium conveyance width MW, respectively. Points C and C1 correspond to the respective end portions of the grips 301 in a longitudinal direction of the pressure roller 203. Note that the respective ends of the grips 301 are located on opposed axial end sides of the fixing belt 201, that is, on flange 208 sides. With respect to the nip formation pad 206 illustrated in FIG. 3, the points A, B, B1, C, and C1 are aligned substantially on a straight line. By contrast, in an encircled area P in FIG. 4, the nip formation pad 206 is curved toward the stay 207 in the grip area 301A as illustrated in the enlarged view in FIG. 4. In other words, the nip formation pad 206 includes a nip face 206*f*, which has an inflection point from which a longitudinal direction of the nip face 206*f* is curved toward the stay 207 (i.e., support) within the grip area 301A, which is an area opposite the grip 301.

Specifically, in the enlarged view in FIG. 4, a broken line BC indicates the nip face 206*f* of the nip formation pad 206 having a planar shape; whereas a curve BD indicates the nip face 206*f* of the nip formation pad 206 having a curved shape. Specifically, the nip face 206*f* of the nip formation pad 206 contacts the fixing belt 201. The nip formation pad 206 (more specifically, the nip face 206*f*) has an inflection point that turns at least part of the nip face 206*f* within the grip area 301A (i.e., area opposite the grip 301) toward the stay 207 (i.e., support) from one of a line and a circle through the points A, B, and B1 on the nip face 206*f*. The point A is a longitudinal center point of the nip face 206*f*. The points B and B1 are opposed end points of the maximum recording medium conveyance width MW (i.e., maximum width of the recording medium S conveyable in the fixing device 200). Such a configuration reduces the deformed amount of the pressure roller 203 by a length of a line segment CD, resulting in reduction of the surface pressure in the fixing nip N. The length of the line segment CD is set according to the deformed amount of the pressure roller 203 and a target surface pressure of the grip 301. In the present example, the length of the line segment CD is 0.3 mm.

In the enlarged view in FIG. 4, the nip formation pad 206 is curved from the point B. Alternatively, in consideration of variations, the nip formation pad 206 may be curved toward the stay 207 (i.e., support) starting from the middle (e.g., midpoint X of the points B and C) within the grip area 301A (i.e., area opposite the grip 301) as illustrated in FIG. 5.

Referring now to FIG. 6, a description is given of the surface pressure distribution in the fixing nip N formed by the nip formation pad 206 shaped as illustrated in the enlarged view in FIG. 4.

FIG. 6 is a diagram illustrating relative lengths of the components of the fixing device 200 in a case in which the nip formation pad 206 is shaped as illustrated in the enlarged view in FIG. 4, with a graph of the surface pressure distribution in the fixing nip N.

As illustrated in FIG. 6, portions of the nip formation pad 206 opposite the grips 301 of the pressure roller 203 are curved toward the stay 207. Such a configuration of the nip formation pad 206 reduces the deformed amount of the pressure roller 203 and the surface pressure of the grips 301 of the pressure roller 203.

Figure 7:
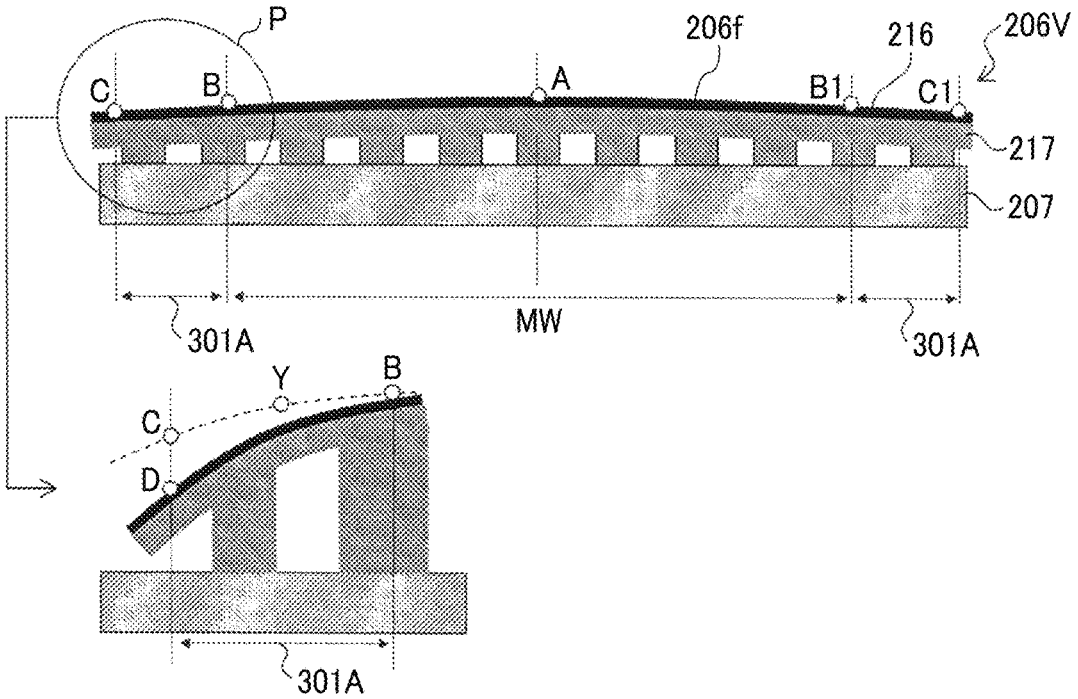
FIG. 7 is a diagram illustrating a variation of the nip formation pad, with an enlarged view of an example of a longitudinal end portion of the variation of the nip formation pad.
Figure 8:
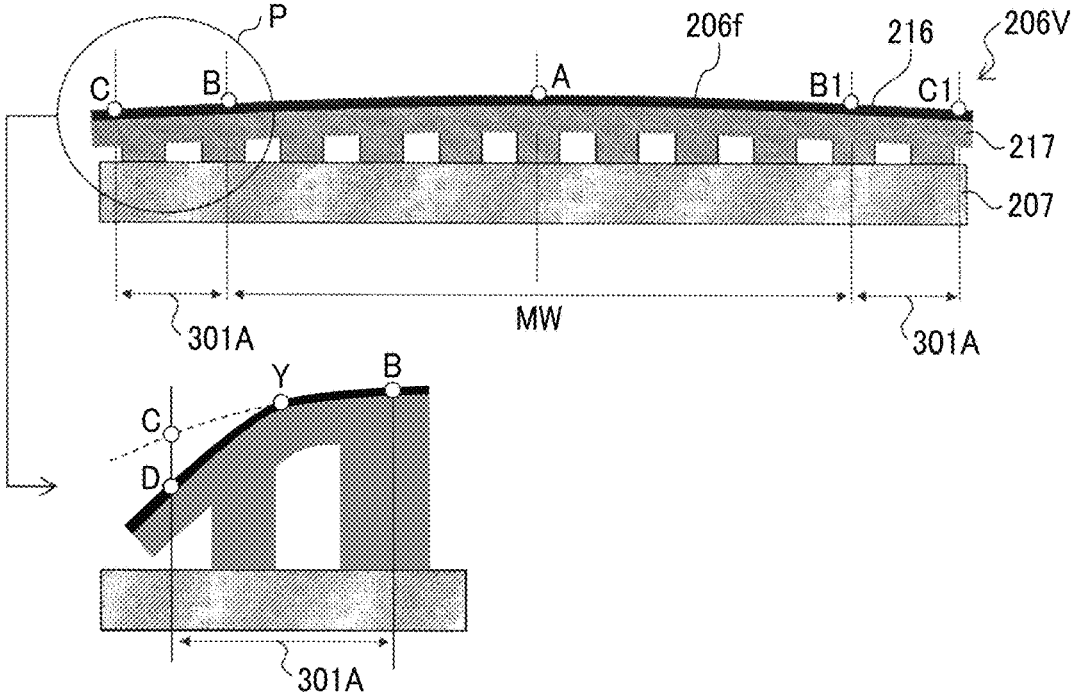
FIG. 8 is a diagram illustrating the variation of nip formation pad, with an enlarged view of another example of the longitudinal end portion of the nip formation pad curved from a middle within the grip area.

Referring now to FIGS. 7 and 8, a description is given of a variation of the nip formation pad 206.

FIG. 7 is a diagram illustrating a nip formation pad 206V as a variation of the nip formation pad 206, with an enlarged view of an example of a longitudinal end portion of the nip formation pad 206V. FIG. 8 is a diagram illustrating nip formation pad 206V, with an enlarged view of another example of the longitudinal end portion of the nip formation pad 206 curved from a middle within the grip area.

The pressure roller 203 is pressed against the nip formation pad 206V to form the fixing nip N. Generally, the stay 207 supports the load applied from the pressure roller 203 via the nip formation pad 206. However, the stay 207 may be warped depending on the strength of the stay 207. In such a case, a longitudinal center portion of the nip formation pad 206 is separated from the pressure roller 203. As a consequence, the fixing nip N becomes narrow at the longitudinal center portion of the nip formation pad 206, thus reducing the pressure and causing a fixing failure.

To cancel the warp of the stay 207 due to the load applied from the pressure roller 203, a longitudinal center portion of the nip formation pad 206V projects toward the pressure roller 203 (i.e., pressure rotator) as illustrated in FIG. 7. In this case, the thermal conduction aid 216 of the nip formation pad 206V becomes substantially flat when receiving the load applied from the pressure roller 203. As a consequence, the surface pressure may be increased by an outer diameter difference of the pressure roller 203 in the grip area 301A in the fixing nip N. To address such a situation, portions of the nip formation pad 206V opposite the grips 301 of the pressure roller 203 are preferably curved toward the stay 207.

The shape of the thermal conduction aid 216 illustrated in FIG. 7 can be approximated by an arc because an amount of projection of the thermal conduction aid 216 toward the pressure roller 203 is smaller than a longitudinal length of the thermal conduction aid 216. Although the points A, B, B1, C, and C1 are substantially on the same arc, the portion of the nip formation pad 206V opposite the grip 301 is preferably curved from a state indicated by a broken curve BC to a state indicated by a solid curve BD in the enlarged view in FIG. 7. Such a configuration reduces the deformed amount of the pressure roller 203 by a length of a line segment CD, resulting in reduction of the surface pressure in the fixing nip N. The length of the line segment CD is set according to the deformed amount of the pressure roller 203 and a target surface pressure of the grip 301. In the present example, the length of the line segment CD is 0.3 mm.

In the enlarged view in FIG. 7, the nip formation pad 206V is curved from the point B. Alternatively, in consideration of variations, the nip formation pad 206V may be curved toward the stay 207 (i.e., support) starting from the middle (e.g., midpoint Y of the points B and C) within the grip area 301A (i.e., area opposite the grip 301) as illustrated in FIG. 8. Such a configuration attains the surface pressure distribution in the fixing nip N as illustrated in FIG. 6 and prevents abrasion of the fixing belt 201 and the nip formation pad 206V.

As described above, in the present embodiment, the longitudinal end portions of the nip formation pad 206 are shaped in a direction away from the pressure roller 203. Unlike a typical nip formation pad, each of the longitudinal end portions of the nip formation pad 206 is shaped in the direction away from the pressure roller 203 in an area of pressure between the pressure roller 203 and the nip formation pad 206. Although the pressure roller 203 having an outer diameter increasing toward the longitudinal end portions of the pressure roller 203 prevents wrinkles of recording media S, the surface pressure between the flat nip formation pad 206 and the pressure roller 203 increases toward the longitudinal end portions of the flat nip formation pad 206 and the pressure roller 203. To address such a situation, the nip formation pad 206 of the present embodiment is shaped in a direction away from the pressure roller 203 by an increase in the outer diameter of the pressure roller 203. Accordingly, the pressure roller 203 is pressed against the nip formation pad 206 via the fixing belt 201 in a low surface pressure, without being separated from the nip formation pad 206. Thus, the nip formation pad 206 of the present embodiment prevents the fixing belt 201 from slipping in the grip area 301A while the fixing belt 201 rotates in accordance with rotation of the pressure roller 203. In addition, the nip formation pad 206 of the present embodiment reduces abrasion of the fixing belt 201 and the nip formation pad 206 in the grip area 301A.

In other words, in the present embodiment, the portion of the nip formation pad 206 opposite the grip 301 of the pressure roller 203 is shaped in the direction away from the pressure roller 203. Such a shape of the nip formation pad 206 reduces the deformed amount of the grips 301 of the pressure roller 203 compared to other portions when the pressure roller 203 is pressed against the nip formation pad 206 via the fixing belt 201. Accordingly, the surface pressure is reduced in the grip area 301A. That is, the present embodiment prevents early abrasion of the nip formation pad 206 and the inner circumferential surface of the fixing belt 201 in the grip area 301A.

Accordingly, the embodiments of the present disclosure lengthen the lifespan of the fixing device while keeping stable conveyance of recording media.

According to the embodiments described above, the fixing belt 201 serves as a fixing rotator. Alternatively, a fixing film, a fixing sleeve, or the like may be used as a fixing rotator. Further, the pressure roller 203 serves as a pressure rotator. Alternatively, a pressure belt or the like may be used as a pressure rotator.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

What is claimed is:

1. A fixing device comprising:

a fixing rotator;

a pressure rotator disposed opposite the fixing rotator;

a heat source configured to heat the fixing rotator;

a nip formation pad configured to press against the pressure rotator via the fixing rotator to form a fixing nip between the fixing rotator and the pressure rotator; and a support configured to support the nip formation pad toward the fixing nip, a longitudinal end portion of the pressure rotator having an outer diameter greater than an outer diameter of a longitudinal center portion of the pressure rotator, the pressure rotator including a grip configured to contact the nip formation pad via the fixing rotator outside a recording medium passing through the fixing nip and apply a frictional force to the fixing rotator, the recording medium having a maximum width conveyable in the fixing device, the nip formation pad including a nip face having an inflection point from which a longitudinal direction of the nip face is curved toward the support within an area opposite the grip.

2. The fixing device according to claim 1, wherein the nip formation pad includes:

a slide aid configured to contact an inner circumferential surface of the fixing rotator; and a slide aid support configured to support the slide aid, wherein the slide aid is a metal material having a belt side coated, and wherein the belt side of the slide aid is configured to contact the inner circumferential surface of the fixing rotator.

3. The fixing device according to claim 1, wherein the nip face of the nip formation pad is configured to contact the fixing rotator, and wherein the inflection point turns at least part of the nip face within the area opposite the grip toward the support from one of a line and a circle through a longitudinal center point of the nip face and opposed end points of the maximum width of the recording medium on the nip face.

4. The fixing device according to claim 1, wherein a longitudinal center portion of the nip formation pad projects toward the pressure rotator.

5. The fixing device according to claim 1, wherein the nip formation pad is curved toward the support starting from a middle within the area opposite the grip.

6. An image forming apparatus comprising:

an image bearer configured to bear a toner image; and the fixing device according to claim 1, the fixing device being configured to fix the toner image onto the recording medium.

* * * * *